US011879473B2

(12) United States Patent
Huang

(10) Patent No.: US 11,879,473 B2
(45) Date of Patent: Jan. 23, 2024

(54) INTELLIGENT BUILT-IN AIR PUMP

(71) Applicant: BESTWAY INFLATABLES & MATERIAL CORP., Shanghai (CN)

(72) Inventor: Shuiyong Huang, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 0 days.

(21) Appl. No.: 17/732,705

(22) Filed: Apr. 29, 2022

(65) Prior Publication Data

US 2022/0349415 A1 Nov. 3, 2022

(30) Foreign Application Priority Data

Apr. 29, 2021 (CN) ..... 202120911606.6

(51) Int. Cl.
*F04D 27/02* (2006.01)
*F04D 25/06* (2006.01)
*F04D 29/66* (2006.01)

(52) U.S. Cl.
CPC ..... *F04D 27/0215* (2013.01); *F04D 25/06* (2013.01); *F04D 29/664* (2013.01)

(58) Field of Classification Search
CPC ..... F04B 41/06; F04D 25/06; F04D 25/16; F04D 25/166; F04D 27/008; F04D 27/0215
See application file for complete search history.

(56) References Cited

U.S. PATENT DOCUMENTS 9,879,682 B1 1/2018 Beliveau et al.
2006/0291964 A1 12/2006 Wang
2013/0136637 A1* 5/2013 Chang ..... F04B 45/043 417/437
2013/0230410 A1 9/2013 Tsai
2015/0316068 A1* 11/2015 Tsai ..... F04D 29/503 417/44.1
2016/0047365 A1* 2/2016 Douglas ..... F04B 45/047 417/222.1
2017/0280884 A1* 10/2017 Liu ..... F04D 25/084
2019/0271322 A1* 9/2019 Huang ..... F04D 25/12

OTHER PUBLICATIONS

Extended European Search Report dated Dec. 6, 2022 (Dec. 6, 2022) issued on related European Patent Application 22170571.8 by the European Patent Office.
Partial European Search Report dated Sep. 30, 2022 (Sep. 30, 2022) issued on related European patent application 22170571.8 by the European Patent Office.

* cited by examiner

*Primary Examiner* — Kenneth J Hansen
(74) *Attorney, Agent, or Firm* — DICKINSON WRIGHT PLLC

(57) ABSTRACT

An air pump is provided, the air pump comprising: an air pump housing; a first check valve; a main air pump; an airway switching device; an air-supplementing pump; an air pressure sensor; and a control device. The control device is electrically connected to the main air pump, the airway switching device, the air-supplementing pump, and the air pressure sensor, and is configured to: send a main air pump stop signal based on the air pressure sensor detecting a threshold pressure in the inflatable body during operation of the main air pump; and send an air-supplementing pump operation signal based on the air pressure sensor detecting a pressure lower than the threshold pressure in the inflatable body when the main air pump is not in operation.

16 Claims, 19 Drawing Sheets

INTELLIGENT BUILT-IN AIR PUMP

CROSS-REFERENCE TO RELATED APPLICATION

This application claims priority from Chinese Application CN 202120911606.6, filed Apr. 29, 2021 in China, the disclosure of which is incorporated herein by reference in its entirety.

BACKGROUND

1. Field

Apparatuses and methods consistent with exemplary embodiments relate to an intelligent built-in air pump for inflating and deflating an inflatable body.

2. Description of the Related Art

An air pump is necessary for inflation of an inflatable body. An inflatable body may be inflated through an air valve on the inflatable body using a hand-held air pump or by using a built-in air pump installed on the inflatable body. With respect to a built-in air pump, a user may control inflation by turning a switch on or off. Compared with any of various hand-held air pumps, a typical built-in air pump is more convenient to use and has a faster inflation speed.

Ordinary built-in air pumps on the market generally have only inflation and deflation functions, but have no air-supplementing function. When an inflatable body is in an inflated state for a period of time, as its material stretches, an internal air pressure of the inflatable body will decrease, causing the inflatable body to become softer and less able to provide sufficient support. Some manufacturers have developed a built-in pump with an air-supplementing function, which may use the conventional structure of a motor driving an impeller to rotate so as to provide inflation or deflation.

A downside of an existing built-in air pump with an air-supplementing function is that it is difficult to accurately measure an internal air pressure of the inflatable body, and thus it is difficult to ensure that the internal air pressure of the inflatable body is sufficiently constant. Additionally, an air-supplementing pump may be very noisy during use, which results in a relatively poor experience for consumers.

SUMMARY

Example embodiments may address at least the above problems and/or disadvantages and other disadvantages not described above. Also, example embodiments are not required to overcome the disadvantages described above, and may not overcome any of the problems described above.

According to an aspect of an example embodiment, an air pump comprises: an air pump housing comprising a first vent and a second vent; a first check valve disposed on the air pump housing and configured to open or close the first vent; a main air pump disposed in an accommodating chamber defined within the air pump housing, the main air pump configured to inflate and deflate an inflatable body via the first vent; an airway switching device being disposed in the accommodating chamber and connected to the main air pump, wherein the airway switching device is configured to: selectively switch among an inflating state, a deflating state, and a closed state, and to selectively control the first check valve to open or close the first vent; an air-supplementing pump disposed in the accommodating chamber and in fluid communication with the interior of the inflatable body to supplement air to the inflatable body; a mechanical air pressure sensor disposed in the accommodating chamber and configured to be in fluid communication with the inflatable body via a port in the air pump housing; and a control device disposed in the accommodating chamber and electrically connected to the main air pump, the airway switching device, the air-supplementing pump, and the air pressure sensor, the control device configured to: send a main air pump stop signal based on the air pressure sensor detecting a threshold pressure in inflatable body during operation of the main air pump; and send an air-supplementing pump operation signal based on the air pressure sensor detecting a pressure lower than the threshold pressure in the inflatable body when the main air pump is not in operation.

The air pump housing may further comprise a partition member disposed in the accommodating chamber, wherein the air pressure sensor is disposed in a closed chamber, within the accommodating chamber, the closed chamber defined by the partition member and the air pump housing.

The air pressure sensor may comprise: a sensor housing; a movable membrane, the movable membrane and the sensor housing defining a first pressure-measuring chamber in fluid communication with the port in the air pump housing and a second pressure-measuring chamber in fluid communication with an exterior of the inflatable body; a pushing member configured to move in conjunction with a movement of the movable membrane, the pushing member comprising a contact; and an air pressure signal switch electrically connected to the control device and comprising a contact point, and the contact point being in contact with the contact of the pushing member to thereby generate an air pressure signal.

The contact of the pushing member and the contact point of the air pressure signal switch may be aligned with each other in a moving direction of the pushing member.

The air pressure sensor may comprise at least one pin extending from the sensor housing configured to cooperate with an insertion hole in at least one of the air pump housing and the partition member.

The air pressure sensor may comprise a vent pipe extending from the sensor housing and fixed to the air pump housing at the port and thereby enabling fluid communication between the first pressure measuring chamber and the inflatable body.

The air-supplementing pump may comprise: a motor assembly comprising: a motor body, a base fixed to the motor body and a rotating member comprising an eccentric hole, an air-supplementing pump air inlet a convex shaft extending from the motor body and through the base and nested with the rotating member; a compression part comprising: a compression piece, a holding body comprising a first check valve, a compression member fixed to the holding body and comprising an airbag, a check blocking piece corresponding to the first check valve, and a buckle extending from the airbag and buckled to the compression piece, a linkage rod extending from the compression piece and inserted into the eccentric hole; and an air collecting part comprising an air-supplementing pump air outlet; wherein the air collecting part and the compression member together define an air collecting chamber and a diversion groove; wherein a flow channel is disposed on the air collecting part corresponding to the airbag, the flow channel enabling fluid communication between the air collecting chamber and the air-supplementing pump air outlet, the flow channel comprising a second check valve; and wherein the diversion groove enables fluid communication between the airbag and the first check valve.

The air pump may further comprise sound-absorbing cotton at least partially covering the air-supplementing pump.

In the inflating state, the airway switching device may provide fluid communication between an output of the main air pump and the first vent, and in the deflating state, the airway switching device may provide fluid communication between an input of the main air pump and the first vent.

According to an aspect of another example embodiment, an air pump comprises: a housing comprising a first vent and a second vent; a main air pump disposed in the housing and configured to pump fluid into and out of the first vent; an air-supplementing pump disposed in the housing and configured to pump fluid into a supplementing port in the housing; an air pressure sensor disposed in the housing and configured to sense a pressure via a pressure-measuring port in the housing; a controller disposed in the housing and electrically connected to the main air pump, the air-supplementing pump, and the air pressure sensor, wherein the controller is configured to: control the a main air pump to stop pumping based on the air pressure sensor detecting a threshold pressure during operation of the main air pump; and control the air-supplementing pump to start pumping based on the air pressure sensor detecting a pressure lower than the threshold pressure when the main air pump is not in operation.

The air pump may further comprise a partition member disposed in the housing, wherein the air pressure sensor is disposed in a closed chamber defined by the partition member and the housing.

The air pressure sensor may comprise: a sensor housing; a moveable membrane dividing an interior of the sensor housing into a first pressure chamber in communication with the pressure-measuring port and a second pressure chamber; a pushing member configured to move in conjunction with a movement of the moveable membrane; an air pressure signal switch electrically connected to the controller and configured to send an air pressure signal to the controller upon contact between a contact connected to the pushing member and a contact on the air pressure signal switch.

The air-supplementing pump may comprise: a motor assembly comprising: a motor body, a base fixed to the motor body and comprising an eccentric hole therethrough, a rotating member, an air inlet, and a shaft extending from the motor body, through the base and into the rotating member; a compression part comprising: a compression piece, a holding body comprising a first check valve, a compression member fixed to the holding body and comprising an airbag in fluid communication with the first check valve, a linkage rod extending from the compression piece and into the eccentric hole, and an air collecting part comprising an air-supplementing pump air outlet in fluid communication with an air collecting chamber defined by the air collecting part and the compression member.

The air pump may further comprise sound-absorbing cotton at least partially covering the air-supplementing pump.

The air pump may further comprise: an airway switching device disposed in the housing and connected to the main air pump, the airway switching device configured to selectively switch among an inflating state, a deflating state, and a closed state.

The airway switching device may be further configured to selectively control the first check valve to open or close a first vent in the housing.

In the inflating state, the airway switching device may provide fluid communication between an output of the main air pump and the first vent, and in the deflating state, the airway switching device may provide fluid communication between an input of the main air pump and the first vent.

The air pump may further comprise a first check valve disposed on the housing and configured to open or close the first vent; wherein in the closed state, the switching device is configured to control the first check valve to close the first vent.

BRIEF DESCRIPTION OF THE DRAWINGS

The above and/or other aspects will become apparent and more readily appreciated from the following description of example embodiments, taken in conjunction with the accompanying drawings, in which.

DETAILED DESCRIPTION

Figure 1:
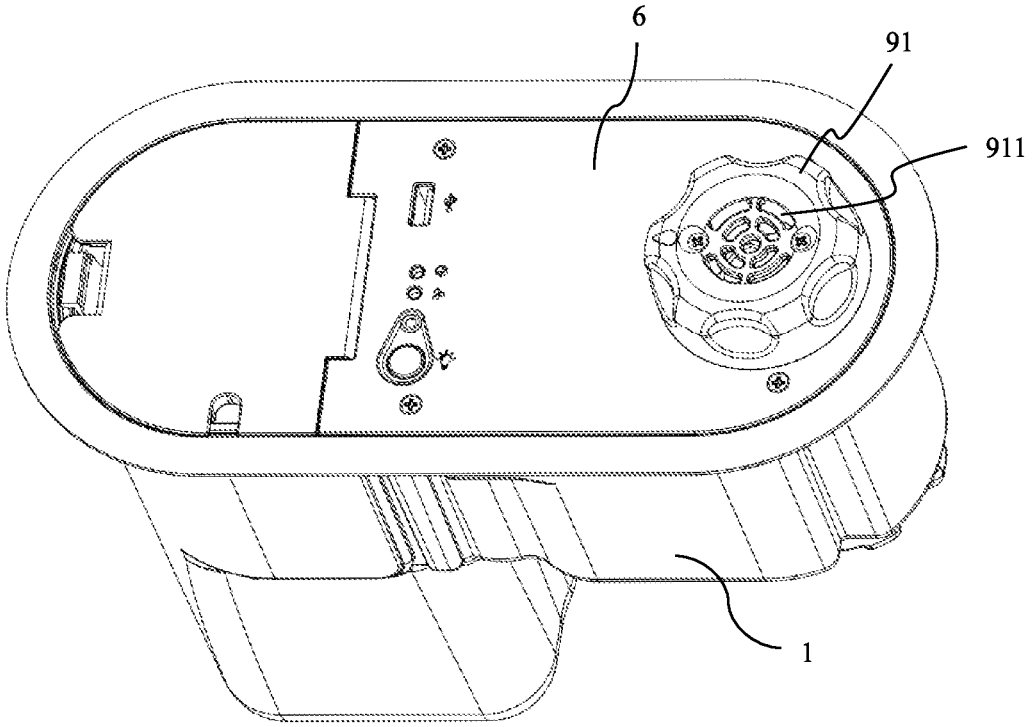
FIG. 1 is a schematic structural diagram of an intelligent built-in air pump according to an example embodiment.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise, and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items. Expressions such as "at least one of," when preceding a list of elements, modify the entire list of elements and do not modify the individual elements of the list.

Various terms are used to refer to particular system components. Different companies may refer to a component by different names—this document does not intend to distinguish between components that differ in name but not function.

Matters of these example embodiments that are obvious to those of ordinary skill in the technical field to which these exemplary embodiments pertain may not be described here in detail.

Figure 2:
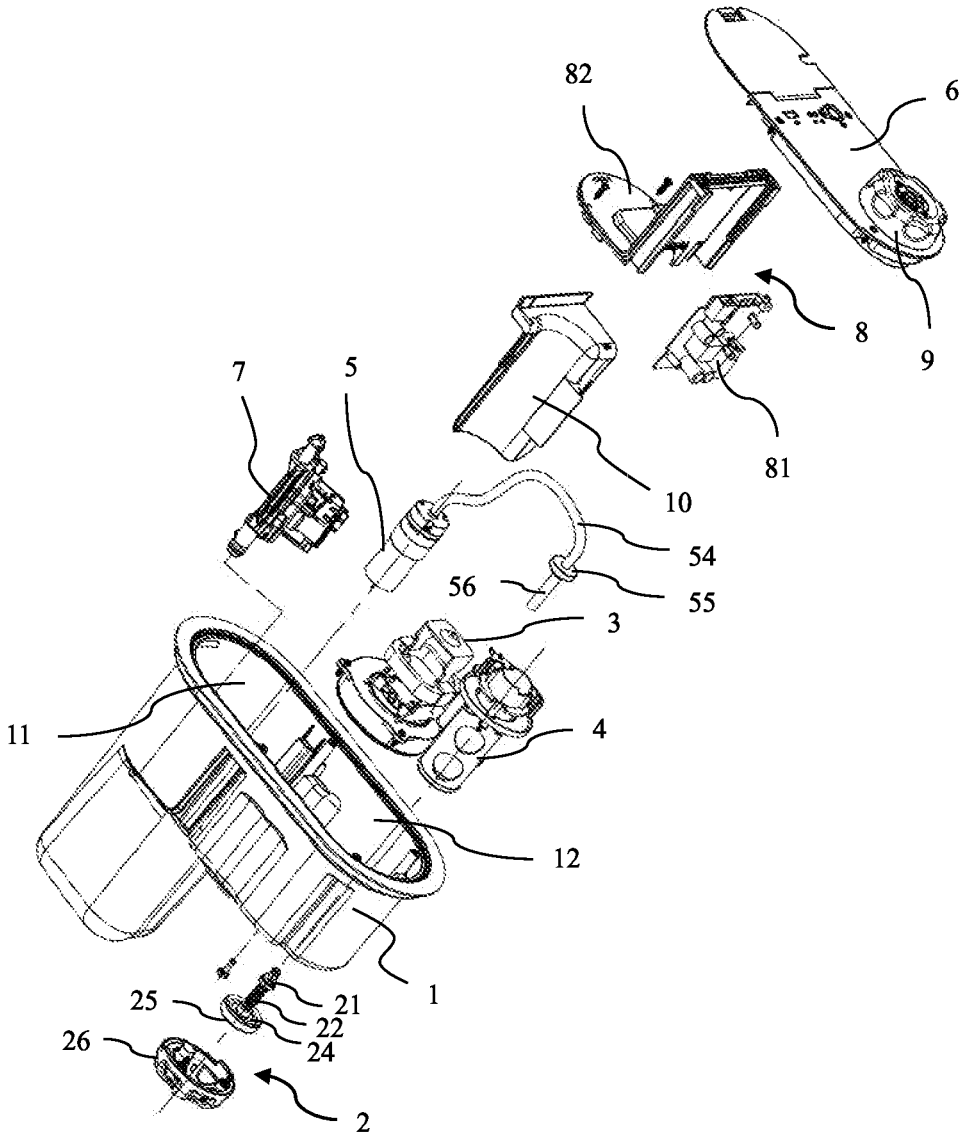
FIG. 2 is a schematic exploded view of the intelligent built-in air pump of FIG. 1.
Figure 3:
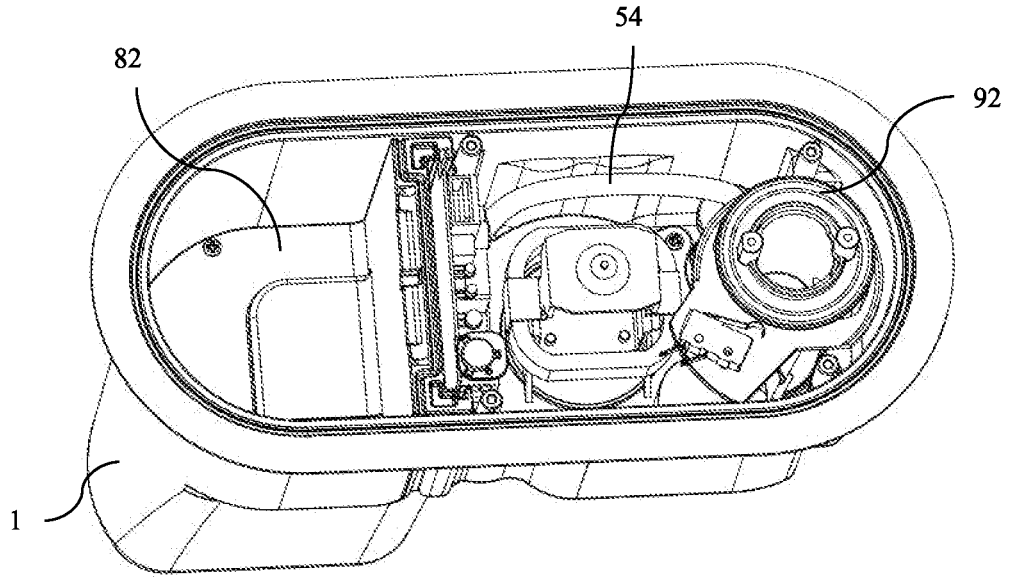
FIG. 3 is a first schematic partial structural diagram of the intelligent built-in air pump of FIG. 1.

As shown in FIG. 1 and FIG. 2, an intelligent built-in air pump according an example embodiment comprises an air pump housing, a first check valve 2, a main air pump 3, an airway switching device 4, an air-supplementing pump 5, an air pressure sensor 7 and a control device 8.

The air pump housing comprises a housing base 1 and a panel 6, and the housing base 1 defines an accommodating chamber 11 and is provided with a housing opening 12, as well as a first vent 13 (see FIG. 7), a pressure-measuring port 14 and an air-supplementing port 15 (see FIG. 7) that are in fluid communication with an interior of an inflatable body. The first check valve 2 is arranged on the housing base 1 at the first vent 13, so as to open or close the first vent 13. The main air pump 3, the airway switching device 4, the air-supplementing pump 5, and the air pressure sensor 7 are arranged in the accommodating chamber 11 and are separately electrically connected to the control device 8. The panel 6 is fixedly connected to the housing base 1 and covers a part or an entirety of the housing opening 12. The panel 6 is further provided with a second vent 61 (covered by a control switch 91 in FIG. 1 and FIG. 2) that is in fluid communication with an exterior of the inflatable body, and the first vent 13 is in fluid communication with the second vent 61 via the accommodating chamber 11.

The intelligent built-in air pump further comprises the control switch 91 and a hollow connecting pipe 92 (see FIG. 10 to FIG. 16). The control switch 91 is arranged on the panel 6 at the second vent 61 and is connected to the connecting pipe 92, and the control switch 91 is provided with a switch vent 911 that enables the second vent 61 to be in fluid communication with the exterior of the inflatable body.

The main air pump 3 inflates or deflates the inflatable body through the first vent 13 and the second vent 61. The airway switching device 4 is connected to the main air pump 3 and selectively switches between any two of an inflating airway, a deflating airway, and a closed airway, and the airway switching device 4 further selectively controls the first check valve 2 to open or close the first vent 13. When the first check valve 2 opens the first vent 13, the first vent 13 is in fluid communication with the interior of the inflatable body, thereby allowing a gas to flow through the first vent 13, and further inflating or deflating the inflatable body (see FIG. 14 and FIG. 15); and when the first check valve 2 closes the first vent 13, the fluid communication between the first vent 13 and the interior of the inflatable body is blocked, thereby preventing the gas from flowing through the first vent 13 (see FIG. 16).

Figure 12:
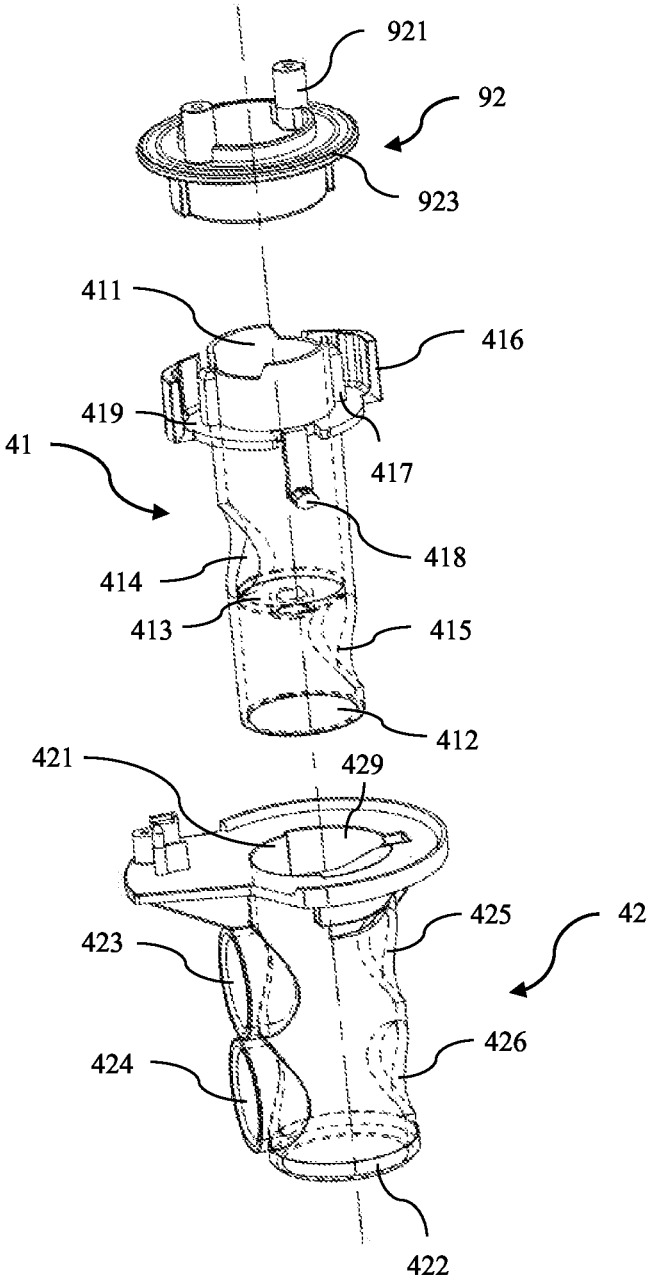
FIG. 12 is a schematic partial exploded view of the intelligent built-in air pump of FIG. 1, showing the connecting pipe and an airway switching device, in which the airway switching device is switched to a deflating airway.

As shown in FIG. 8 to FIG. 16, the airway switching device 4 comprises an inner tube 41 and an outer tube 42 that are hollow; an upper end and a lower end of the inner tube 41 are respectively provided with a first inner tube opening 411 and a second inner tube opening 412; the first inner tube opening 411 is in fluid communication with the exterior of the inflatable body via the connecting pipe 92; and the second inner tube opening 412 is in fluid communication with the first vent 13. As shown in FIG. 12, a first slider 417 cooperating with the connecting pipe 92, a second slider 418 cooperating with the outer tube 42, and an inner tube flange 419 are arranged on an outer side of the inner tube 41. An arc-shaped piece 416 is arranged at an edge of an upper surface of the inner tube flange 419, and a partition piece 413 is arranged in the inner tube 41 and divides an interior of the inner tube 41 into an upper part and a lower part that are not in communication with each other. Inner tube walls on an upper side and a lower side of the partition piece 413 are respectively provided with a third inner tube opening 414 and a fourth inner tube opening 415, and opening directions of the third inner tube opening 414 and the fourth inner tube opening 415 are opposite each other. The outer tube 42 sleeves an outer side of the inner tube 41, and its upper and lower ends are respectively provided with a first outer tube opening 421 and a second outer tube opening 422. An inner wall of the outer tube 42 is adjacent to an outer wall of the inner tube 41, and the inner tube 41 can axially move and radially rotate inside the outer tube 42. The upper end of the outer tube 42 is provided with an outer tube flange 430, and the lower end of the outer tube 42 is connected to the housing base 1. The first vent 13 on the housing base 1 is located inside the second outer tube opening 422. A wall of the outer tube 42 is respectively provided with a first outer tube air inlet 423 and a second outer tube air inlet 424 that are adjacent up and down and a first outer tube air outlet 425 and a second outer tube air outlet 426 that disposed opposite the first outer tube air inlet 423 and the second outer tube air inlet 424, respectively. The wall of the outer tube 42 is provided with an arc-shaped sliding groove 429 (see FIG. 9) with two low ends and a high middle, and the arc-shaped sliding groove 429 allows the second slider 418 on the inner tube 41 to slide therein.

Based on the above-described structure, when the inner tube 41 is rotated to move the second slider 418 of the inner tube 41 to a first low point A1 of the arc-shaped sliding groove 429 of the outer tube 42 (see FIG. 9 and FIG. 11), the third inner tube opening 414 corresponds to and is in communication with the first outer tube air outlet 425, the fourth inner tube opening 415 corresponds to and is in communication with the second outer tube air inlet 424, and the second outer tube air outlet 426 and the first outer tube air inlet 423 are blocked and closed by the wall of the inner tube 41.

When the inner tube 41 is rotated to move the second slider 418 of the inner tube 41 to a second low point A2 of the arc-shaped sliding groove 429 of the outer tube 42 (see FIG. 9 and FIG. 12), the third inner tube opening 414 corresponds to and is in communication with the first outer tube air inlet 423, the fourth inner tube opening 415 corresponds to and is in communication with the second outer tube air outlet 426, and the first outer tube air outlet 425 and the second outer tube air inlet 424 are blocked and closed by the wall of the inner tube 41.

In actual use, corresponding relationships between the third inner tube opening 414 and the fourth inner tube opening 415 on the inner tube 41 and the first outer tube air outlet 425, the second outer tube air outlet 426, the first outer tube air inlet 423, and the second outer tube air inlet 424 may be changed by rotating the inner tube 41, to enable of switching air flow channels. A main air pump switch 427 is arranged outside the arc-shaped piece 416 of the inner tube 41, and the inner tube 41 may be rotated to enable the arc-shaped piece 416 to be in contact with the main air pump switch 427 and connect or disconnect a power supply in linkage.

Figure 14:
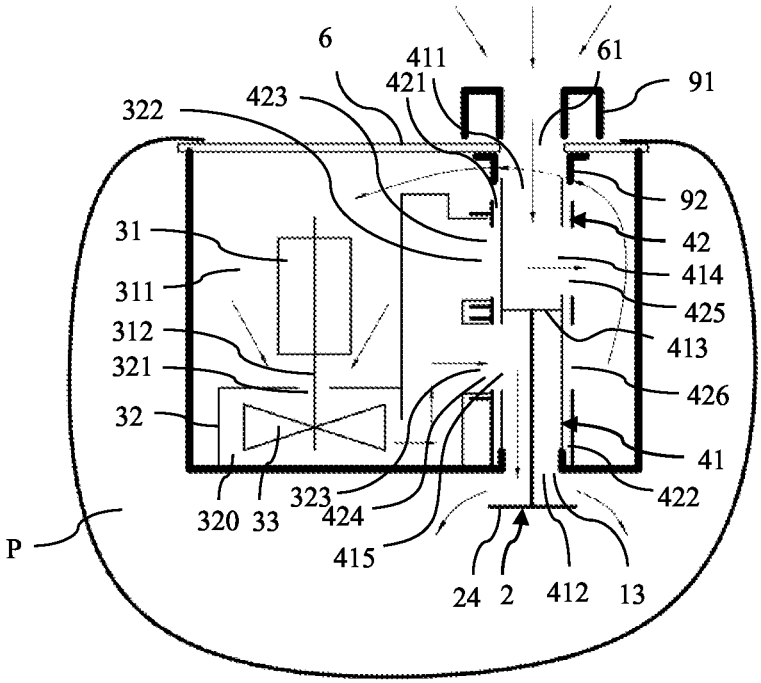
FIG. 14 is a schematic diagram of inflating an inflatable body by the intelligent built-in air pump of FIG. 1.
Figure 15:
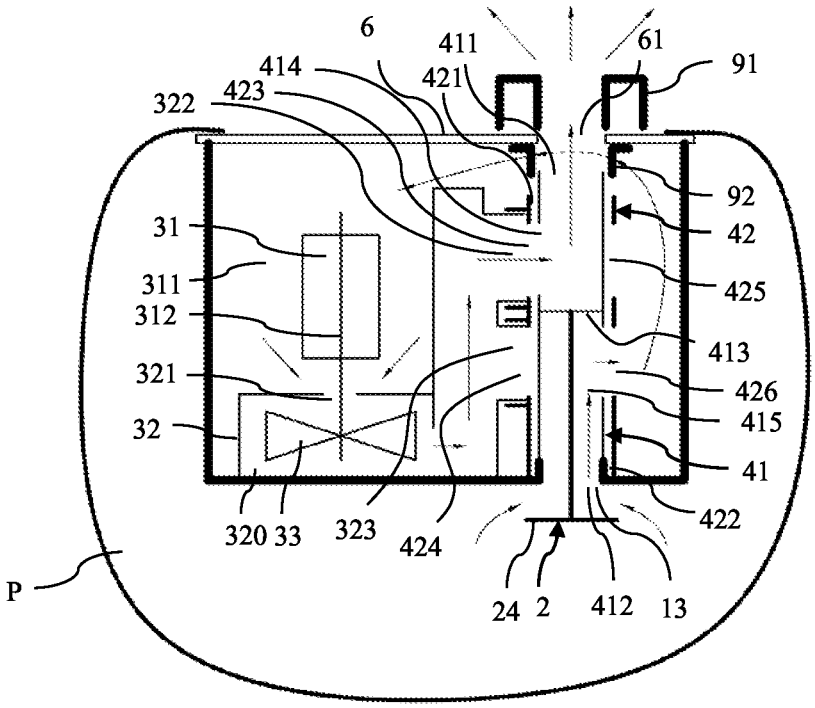
FIG. 15 is a schematic diagram of deflating the inflatable body by the intelligent built-in air pump of FIG. 1.
Figure 16:
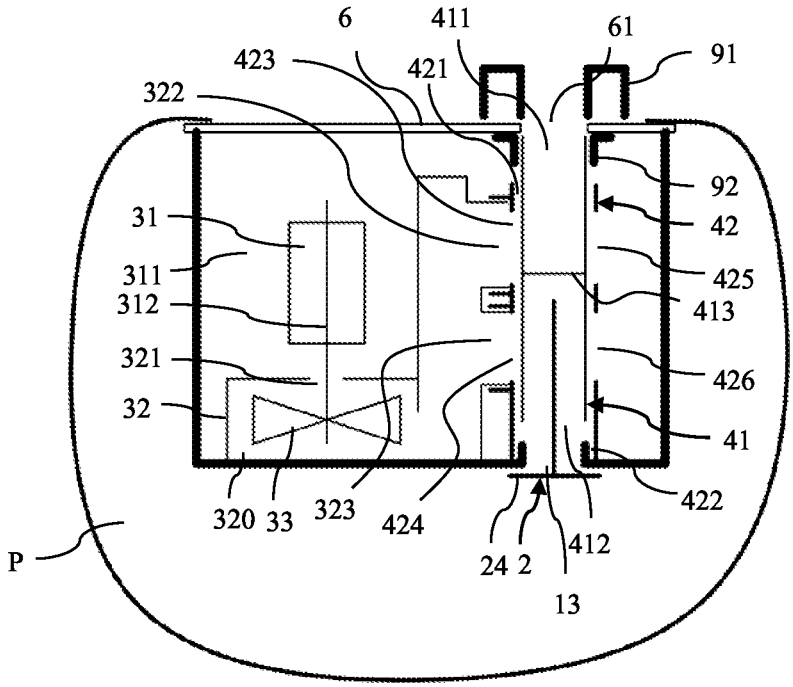
FIG. 16 is a schematic diagram of the intelligent built-in air pump of FIG. 1 that is neither inflating nor deflating.

As shown in FIG. 14 to FIG. 16, the main air pump 3 comprises a fan blade cover 32 fixedly connected to the housing base 1, and the fan blade cover 32 partially divides the accommodating chamber 11 of the housing 1 into a motor chamber 311 and a fan blade chamber 320. The fan blade cover 32 is provided with a fan blade cover air inlet 321, a first fan blade cover air outlet 322 and a second fan blade cover air outlet 323. The fan blade cover air inlet 321 is in fluid communication with the first outer tube air outlet 425 and with the second outer tube air outlet 426, respectively, via the first fan blade cover air outlet 322 and the second fan blade cover air outlet 323. The first fan blade cover air outlet 322 and the second fan blade cover air outlet 323 respectively correspond to and are in fluid communication with the first outer tube air inlet 423 and the second outer tube air inlet 424. The fan blade cover 32 is provided with an impeller 33, and a rotating shaft 312 of the motor 31 runs through the fan blade cover air inlet 321 and is connected to the impeller 33. When the motor 31 operates, a fluid is sucked into the fan blade cover 32 from the fan blade cover air inlet 321, is pressurized by the impeller 33, and then is discharged from the first fan blade cover air outlet 322 or the second fan blade cover air outlet 323.

As shown in FIG. 10 to FIG. 16, the connecting pipe 92 is arranged on an inner side of the panel 6; a top end of the connecting pipe 92 is provided with a connecting pipe flange 923 with a diameter greater than that of the second vent 61 of the panel 6; an upper surface of the connecting pipe flange 923 is adjacent to the inner side of the panel 6; an upper surface of the connecting pipe flange 923 is provided with two connecting pipe bosses 921; and the connecting pipe bosses 921 each run through the second vent 61 and are connected to the control switch 91. The switch vent 911 of the control switch 91 corresponds to and is in fluid communication with the second vent 61 via a switch vent pipe (not shown) of the control switch 91, and a lower end of the connecting pipe 92 is sleeved at an upper end of the inner tube 41 of the airway switching device 4. More specifically, an inner wall of the connecting pipe 92 is provided with a straight sliding groove 922, and the straight sliding groove 922 accommodates the first slider 417 of the inner tube 41 and allows same to slide axially.

Figure 7:
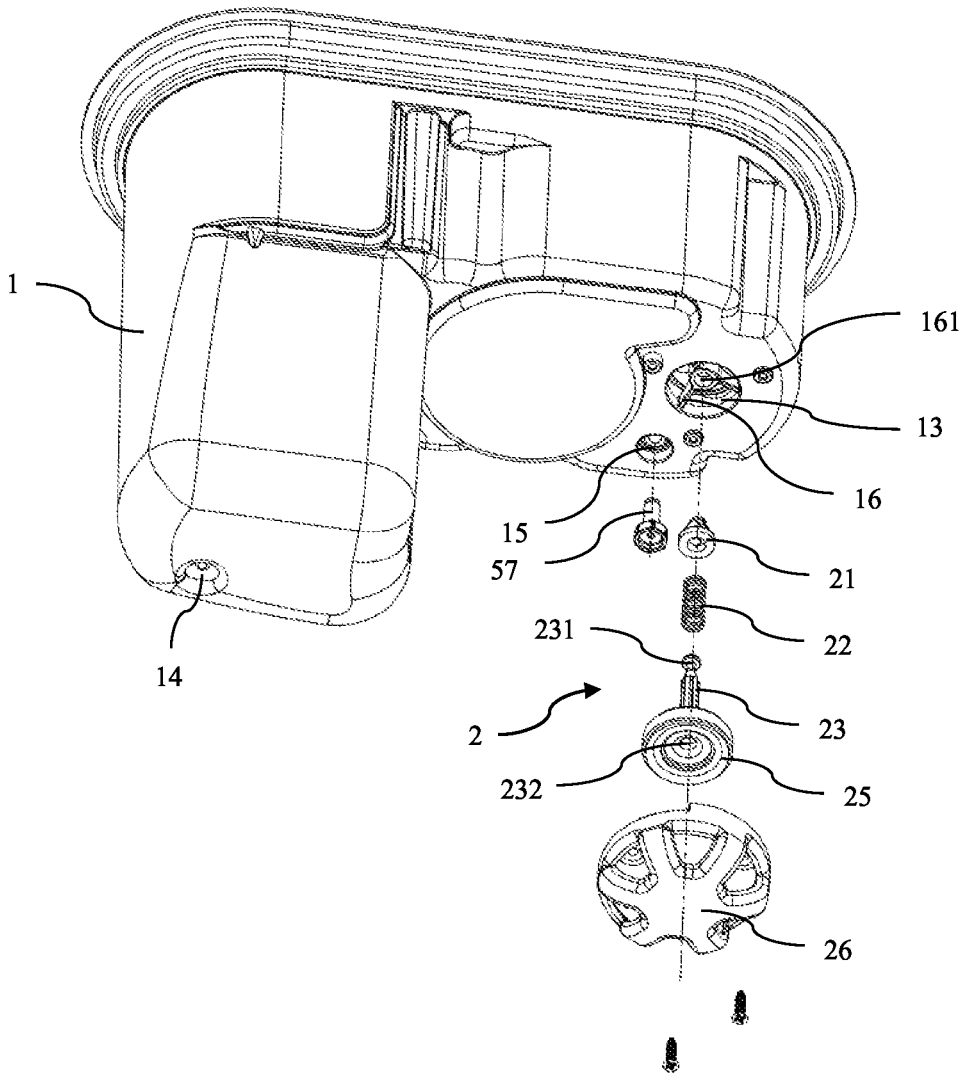
FIG. 7 is a schematic partial exploded view of the intelligent built-in air pump of FIG. 1, showing a housing and a first check valve.
Figure 8:
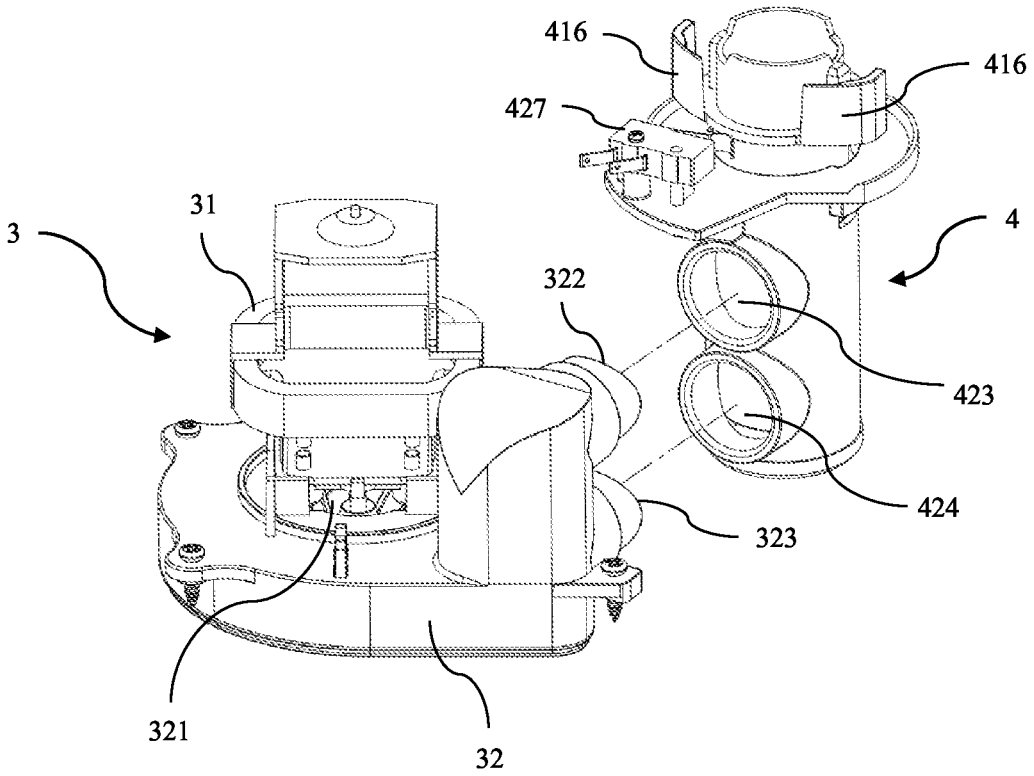
FIG. 8 is a schematic structural diagram of a main air pump and an airway switching device of the intelligent built-in air pump of FIG. 1.
Figure 9:
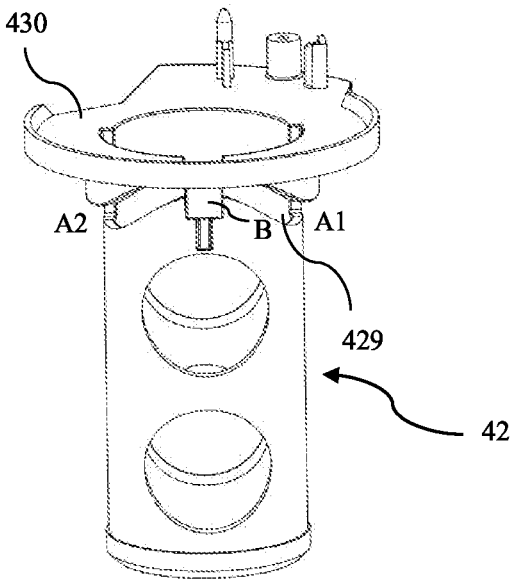
FIG. 9 is a schematic structural diagram of an outer tube of the airway switching device of the intelligent built-in air pump of FIG. 1.
Figure 10:
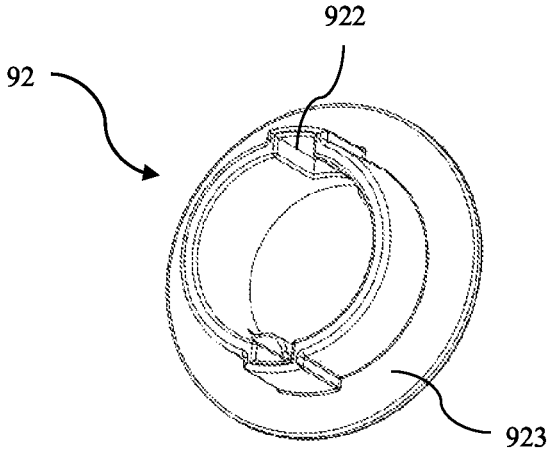
FIG. 10 is a schematic structural diagram of a connecting pipe of the intelligent built-in air pump of FIG. 1.
Figure 11:
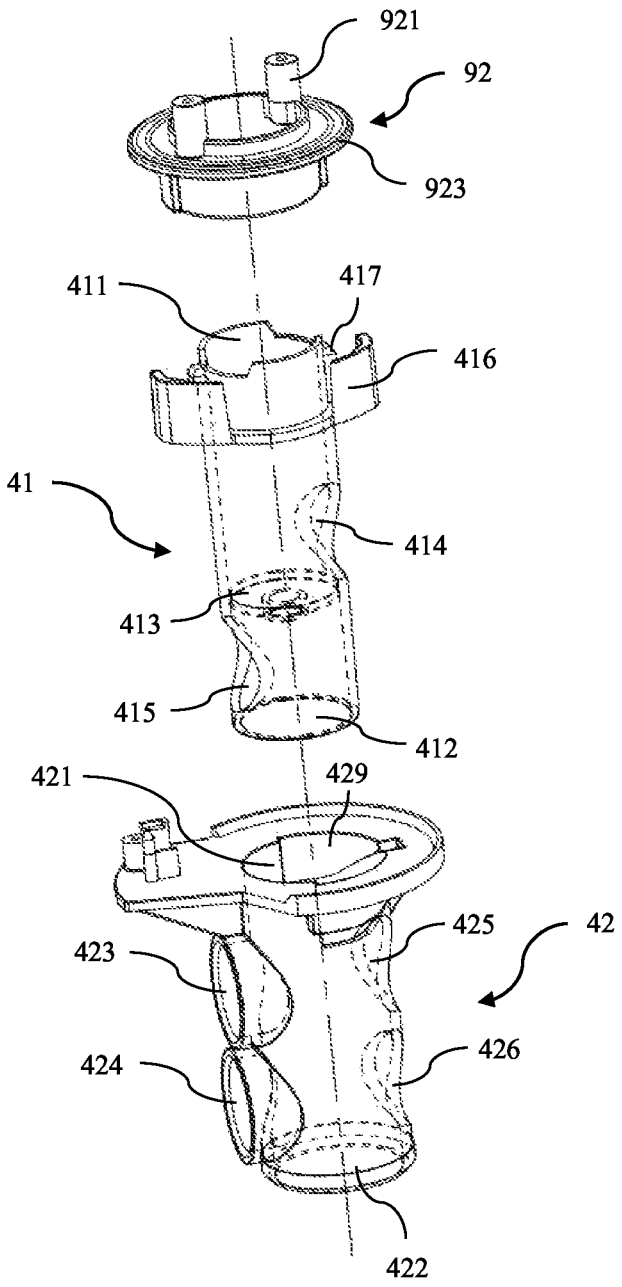
FIG. 11 is a schematic partial exploded view of the intelligent built-in air pump of FIG. 1, showing the connecting pipe and an airway switching device, in which the airway switching device is switched to an inflating airway.

As shown in FIG. 2 and FIG. 7, the first check valve 2 is arranged at the bottom of the housing base 1; a support member 16 is arranged at the first vent 13; a support member through hole 161 is formed in the center of the support member 16; and a valve rod 23 is arranged in the support member through hole 161 and can move along its axial direction. A first end 231 and a second end 232 of the valve rod 23 are respectively connected to a limiting member 21 and a valve disc 24; the first end 231 of the valve rod 23 extends to the inner tube 41 of the airway switching device 4 and abuts against the partition piece 413 of the inner tube 41; a sealing ring 25 covers an outer periphery of the valve disc 24; a spring 22 sleeves the outside of the valve rod 23 and is located between the support member 16 and the limiting member 21; and a protective cover 26 is arranged at the bottom of the housing base 1 to protect the valve disc 24.

Based on the above-described structure, the first vent 13 enables the valve disc 24 and the sealing ring 25 to seal the first vent 13 by means of an elastic force of the spring 22 without any other external force, and the first vent 13 is in a closed state. When the inner tube 41 of the airway switching device 4 moves downward, the partition piece 413 of the inner tube 41 is in contact with the valve rod 23 and applies a downward force on same, so that the first check valve 2 opens the first vent 13, and thus the interior and exterior of the inflatable body are in fluid communication. When the first check valve 2 closes the first vent 13, the interior and exterior of the inflatable body are not in fluid communication.

Based on the above-described structure, a linkage mechanism is formed among the control switch 91, the connecting pipe 92, the inner tube 41 of the airway switching device 4, the first check valve 2, and the main air pump switch 427. When the main air pump 3 is required to inflate the inflatable body, the control switch 91 is rotated from a closed position to an inflation position; the control switch 91 drives the connecting pipe 92 connected thereto, and the connecting pipe 92 drives the inner tube 41 of the airway switching device 4 to axially move and radially rotate; the arc-shaped piece 416 of the inner tube 41 triggers the main air pump switch 427 to switch on a power supply; the main air pump 3 starts to operate; the second slider 418 of the inner tube 41 transversely slides in the arc-shaped sliding groove 429 of the outer tube 42 to the first low point A1 (see FIG. 9 and FIG. 11); the inner tube 41 axially moves downward in the outer tube 42 therewith; and the partition piece 413 pushes open the first check valve 2 to open the first vent 13. The third inner tube opening 414 corresponds to and is in communication with the first outer tube air outlet 425; the fourth inner tube opening 415 corresponds to and is in communication with the second outer tube air inlet 424; the second outer tube air outlet 426 and the first outer tube air inlet 423 are blocked and closed by the wall of the inner tube 41; and the airway switching device 4 is switched to the inflating airway. As shown by the arrows in FIG. 14, fluid external to the inflatable body enters from the switch vent 911 of the control switch 91; enters the fan blade chamber 320 sequentially through the connecting pipe 92, the first inner tube opening 411, the third inner tube opening 414 and the first outer tube air outlet 425 of the airway switching device 4, the motor chamber 311 and the fan blade chamber air inlet 321; and then after pressurized by the impeller 33, the fluid enters the interior of the inflatable body via the second fan blade cover air outlet 323, the second outer tube air inlet 424, the fourth inner tube opening 415, the second inner tube opening 412, and the first vent 13 to inflate the inflatable body P.

When the inflatable body is to be deflated, the control switch 91 is rotated from a closed position to a deflation position; the control switch 91 drives the connecting pipe 92 connected thereto and the connecting pipe 92 drives the inner tube 41 of the airway switching device 4 to rotate at the same time; the arc-shaped piece 416 of the inner tube 41 triggers the main air pump switch 427 to switch on a power supply; and the main air pump 3 starts to operate. When the second slider 418 moves to the second low point A2 of the arc-shaped sliding groove 429 of the outer tube 42 (see FIG. 9 and FIG. 12), the inner tube 41 axially moves downward in the outer tube 42 therewith, and the partition piece 413 thereof pushes open the first check valve 2 to open the first vent 13. The third inner tube opening 414 corresponds to and is in communication with the first outer tube air inlet 423; the fourth inner tube opening 415 corresponds to and is in communication with the second outer tube air outlet 426; the first outer tube air outlet 425 and the second outer tube air inlet 424 are blocked and closed by the wall of the inner tube 41; and the airway switching device 4 is switched to the deflating airway. As shown by the arrows in FIG. 15, an fluid internal to the inflatable body enters the fan blade chamber 320 from the first vent 13, sequentially, through the second inner tube opening 412, the fourth inner tube opening 415, the second outer tube air outlet 426, the motor chamber 311 and the fan blade cover air inlet 321; and then after pressurized by the impeller 33, the fluid is discharged to the exterior of the inflatable body P from the switch vent 911, sequentially, through the first fan blade cover air outlet 322, the first outer tube air inlet 423, the third inner tube opening 414, the first inner tube opening 411, the connecting pipe 92 and the second vent 61.

Figure 13:
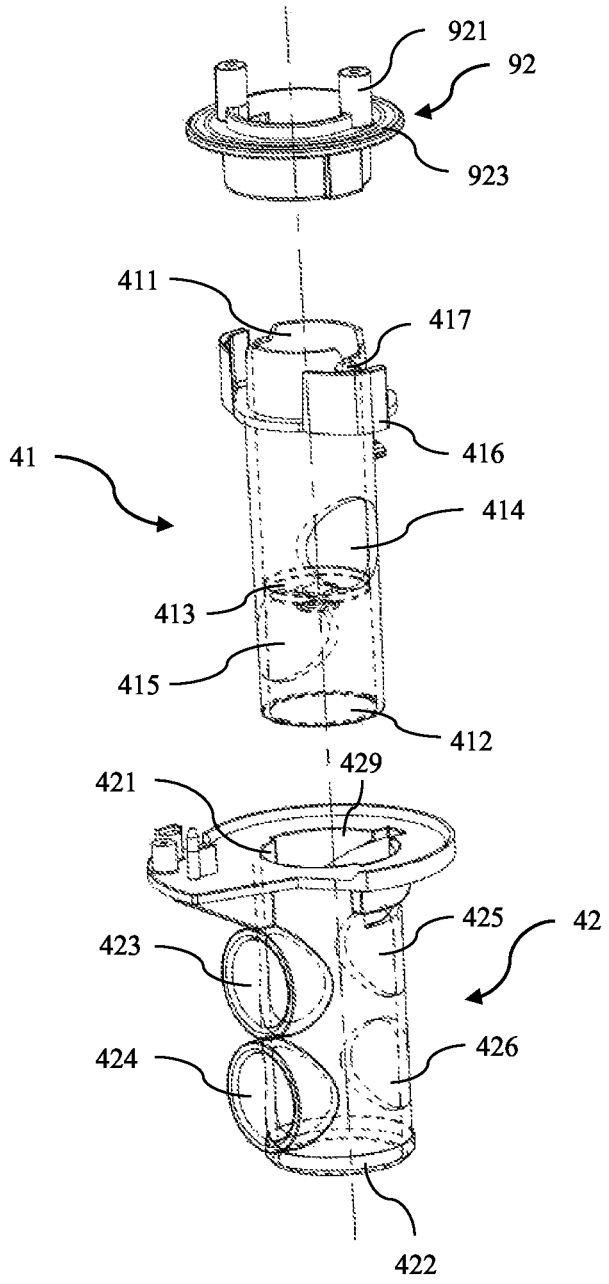
FIG. 13 is a schematic partial exploded view of the intelligent built-in air pump of FIG. 1, showing the connecting pipe and an airway switching device, in which the airway switching device is switched to a closed airway.

When inflation or deflation of the inflatable body is stopped, the control switch 91 is rotated to a stop position; the control switch 91 drives the connecting pipe 92 connected thereto and the connecting pipe 92 drives the inner tube 41 of the airway switching device 4 to rotate at the same time; the arc-shaped piece 416 of the inner tube 41 triggers the main air pump switch 427 to switch off a power supply; the main air pump 3 stops operating; the second slider 418 of the inner tube 41 transversely slides in the arc-shaped sliding groove 429 of the outer tube 42 to a middle high point B (see FIG. 9 and FIG. 13); the inner tube 41 axially moves upward in the outer tube 42 therewith; the partition piece 413 of the inner tube 41 stops applying an external force to the valve rod 23 of the first check valve 2; the valve disc 24 recovers to cover the first vent 13 under the action of the spring 22, so as to close the first vent 13; and the airway switching device 4 is switched to the closed airway, as shown in FIG. 13 and FIG. 16. As a result, the interior of the inflatable body P is prevented from exchanging fluid with the exterior thereof. The fluid of the present utility model is not limited to air, and may be other types of gas.

Figure 4:
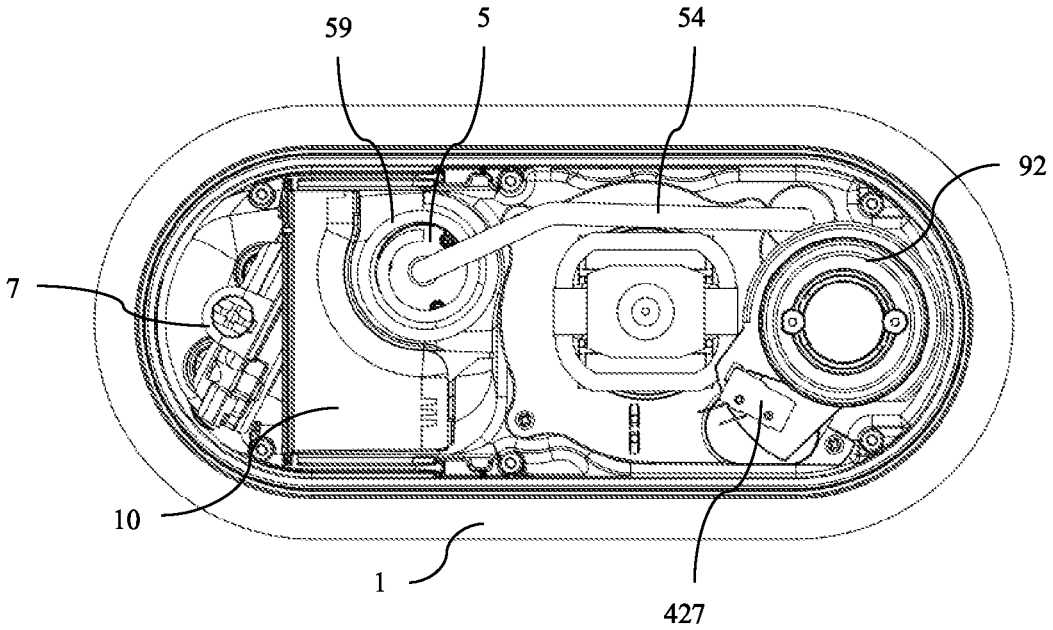
FIG. 4 is a second schematic partial structural diagram of the intelligent built-in air pump of FIG. 1.
Figure 5:
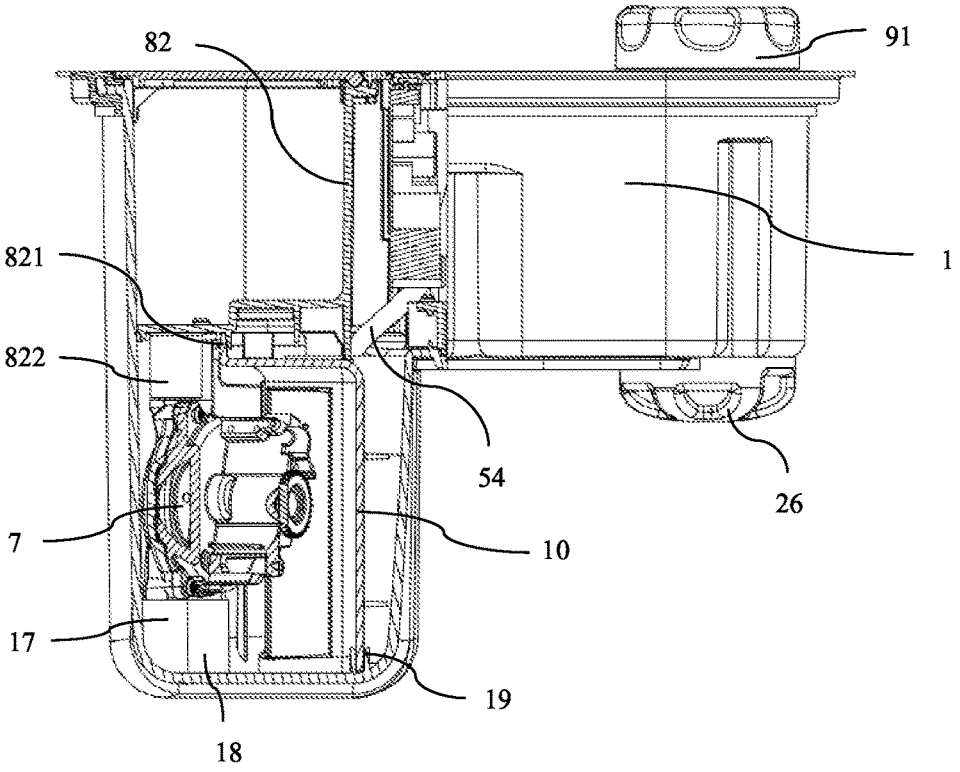
FIG. 5 is a third schematic partial structural diagram of the intelligent built-in air pump of FIG. 1.
Figure 6:
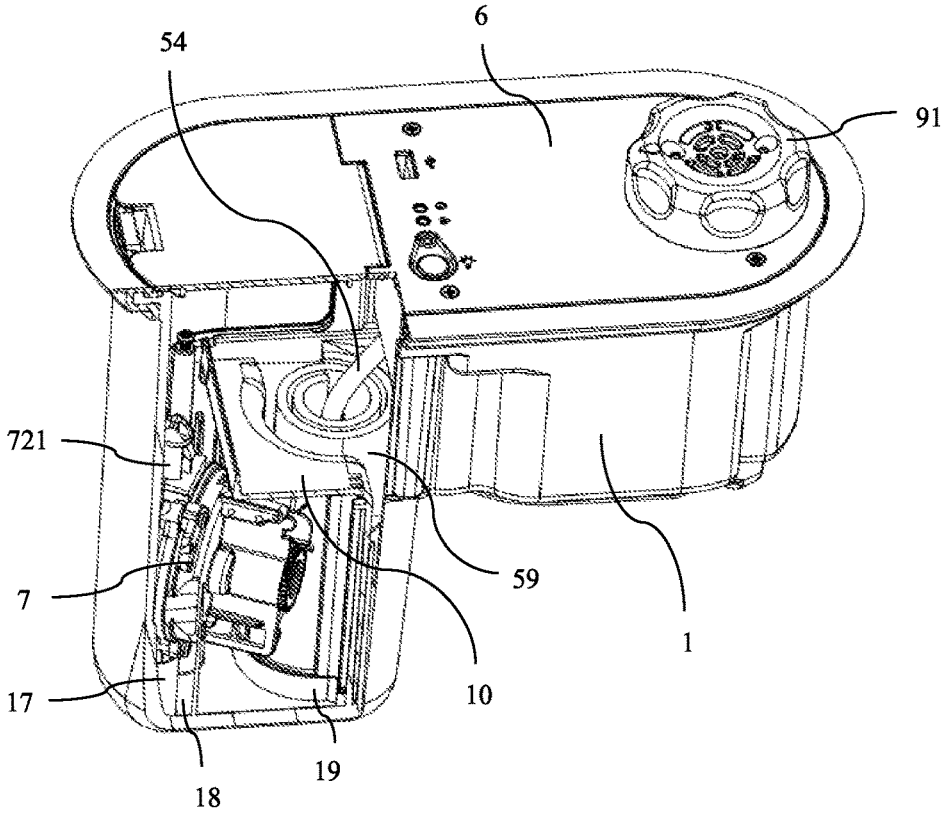
FIG. 6 is a fourth schematic partial structural diagram of the intelligent built-in air pump of FIG. 1.
Figure 17:
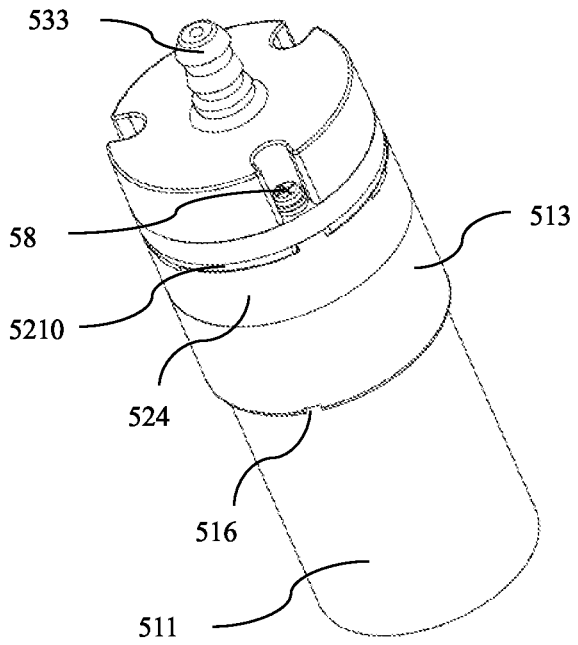
FIG. 17 is a schematic structural diagram of an air-supplementing pump of the intelligent built-in air pump of FIG. 1.
Figure 18:
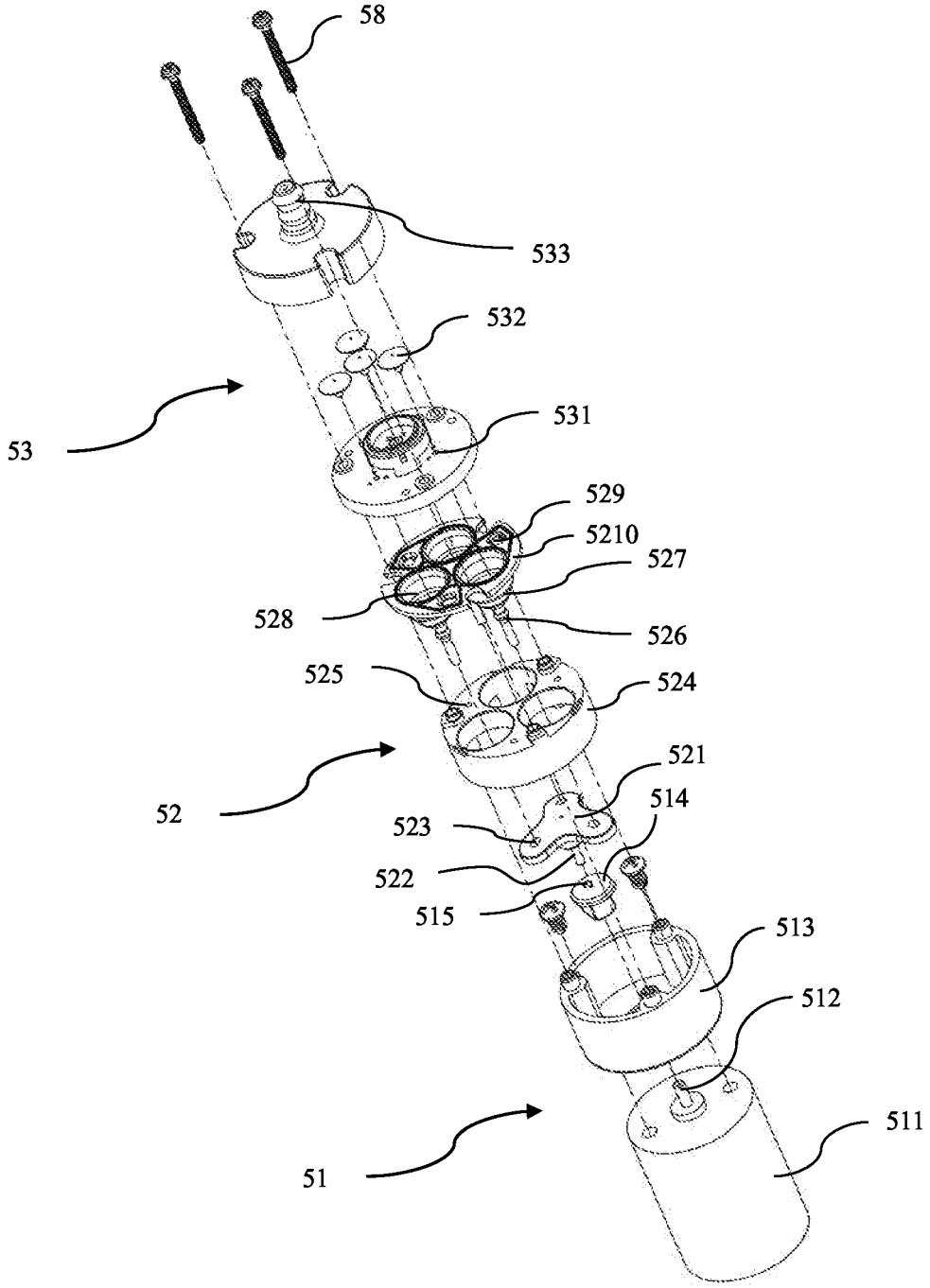
FIG. 18 is a schematic exploded view of the air-supplementing pump of FIG. 17.
Figure 19:
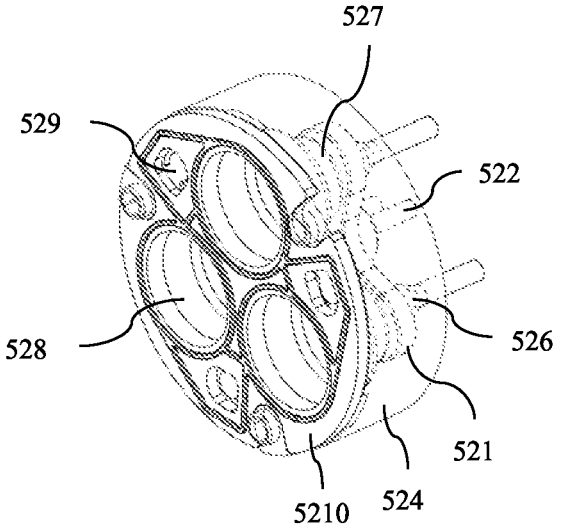
FIG. 19 is a schematic structural diagram of a compression part of the air-supplementing pump of FIG. 17.
Figure 20:
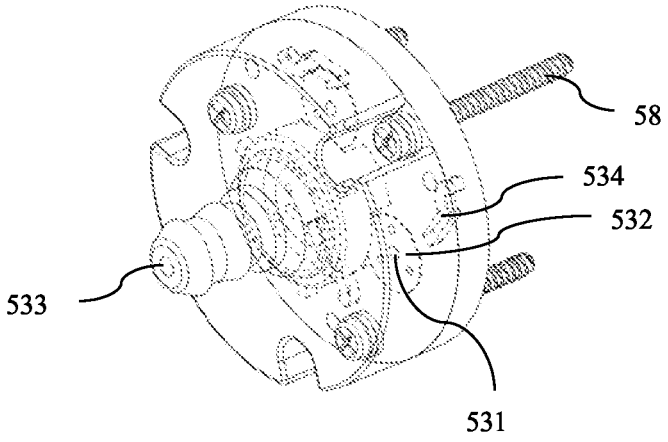
FIG. 20 is a schematic structural diagram of an air collecting part of the air-supplementing pump of FIG. 17.
Figure 21:
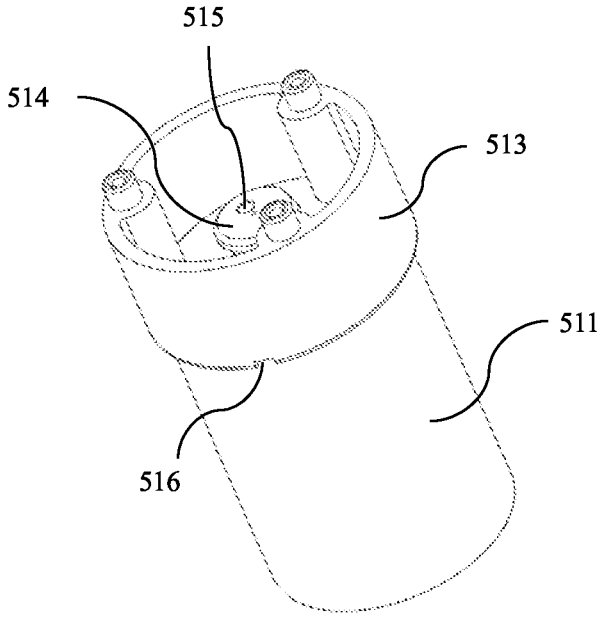
FIG. 21 is a schematic structural diagram of a motor assembly of the air-supplementing pump in FIG. 17.
Figure 22:
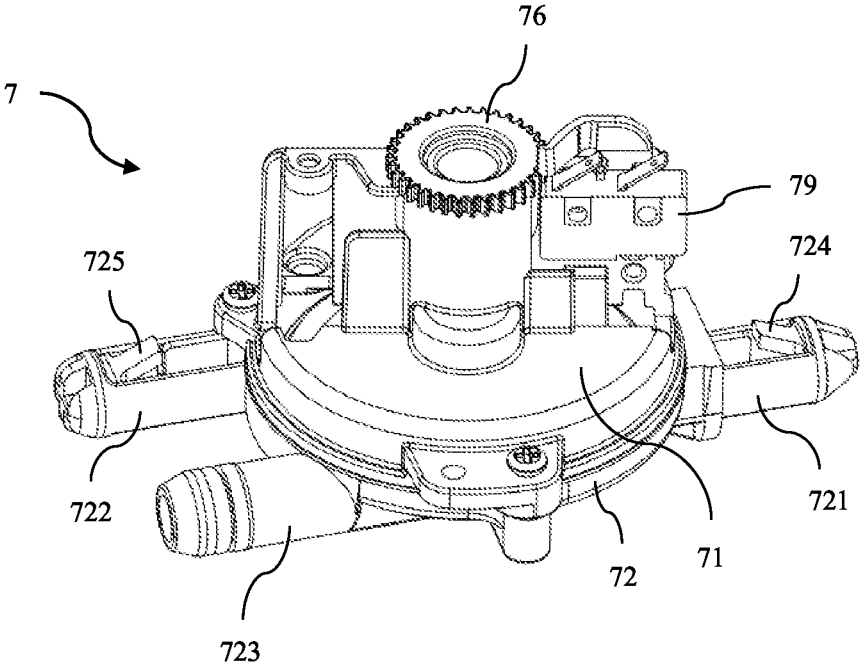
FIG. 22 is a schematic structural diagram of an air pressure sensor of the intelligent built-in air pump of FIG. 1.
Figure 23:
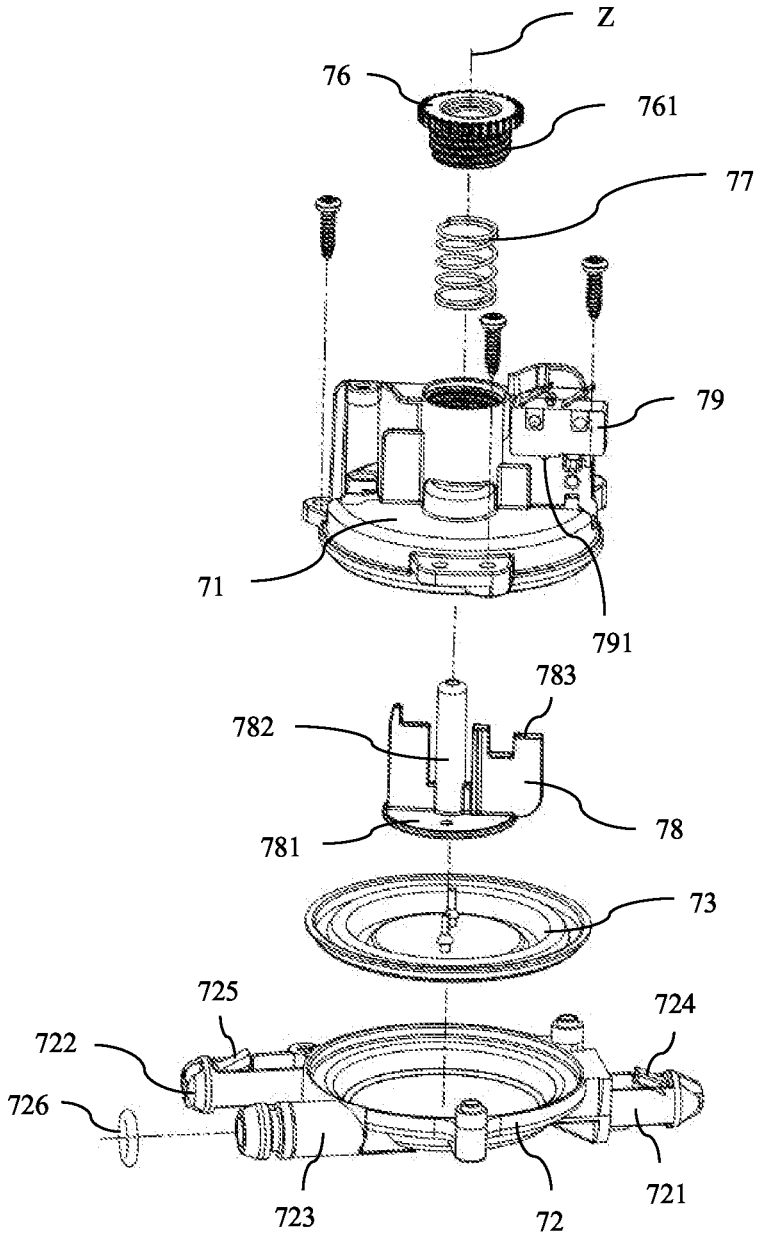
FIG. 23 is a schematic exploded view of the air pressure sensor of FIG. 1.

The air-supplementing pump 5 is fixed in the accommodating chamber 11 of the housing base 1 via a mounting member, and is in fluid communication with the interior of the inflatable body, so that air can be supplemented to the inflatable body after the main air pump 3 inflates the inflatable body. Optionally, the intelligent built-in air pump further comprises sound-absorbing cotton 59 (see FIG. 4 and FIG. 6) partially or entirely covering the air-supplementing pump 5, so as to reduce the vibration of the air-supplementing pump 5 when the air-supplementing pump 5 operates, thereby reducing noise. The air-supplementing pump 5 is provided with an air-supplementing pump air inlet 516 and an air-supplementing pump air outlet 533 (see FIG. 17). The air-supplementing pump air outlet 533 is connected to an air-supplementing pump air outlet pipe 54, a tail end of the air-supplementing pump air outlet pipe 54 is connected to a second check valve 55. The second check valve 55 is in fluid communication with an air-supplementing port fixing member 57 via a check valve connecting pipe 56, and the air-supplementing port fixing member 57 has a hollow structure in fluid communication with the interior of the inflatable body, one part of which is located outside the housing base 1, and the other part of which runs through the air-supplementing port 15 and is configured to fix the check valve connecting pipe 56 to the air-supplementing port 15. The second check valve 55 only allows a fluid to flow into the interior of the inflatable body, and does not allow an internal fluid of the inflatable body to flow out. When the air-supplementing pump 5 supplements air to the inflatable body, the fluid external to the inflatable body enters the accommodating chamber 11 through the vent on the housing base 1 or the panel 6, and enters the interior of the inflatable body through the air-supplementing pump air inlet 516, the air-supplementing pump air outlet 533, the air-supplementing pump air outlet pipe 54, the second check valve 55, the check valve connecting pipe 56, and the air-supplementing port fixing member 57.

FIGS. 17 to 21 show an implementation of the air-supplementing pump 5. The air-supplementing pump 5 is a silent type high-pressure air-supplementing pump, which comprises a motor assembly 51, a compression part 52, and an air collecting part 53. The air-supplementing pump 5 is fixed externally by a latching element 58.

The motor assembly 51 comprises a motor body 511, a base 513, and a rotating member 514, wherein the base 513 is provided with the air-supplementing pump air inlet 516 in communication with the accommodating chamber 11. A convex shaft 512 extending out from the motor body 511 runs through the base 513 and is nested with the rotating member 514, and the rotating member 514 is provided with an eccentric hole 515.

The compression part 52 comprises a compression piece 521, a holding body 524, and a compression member 528, wherein a linkage rod 522 extending out from the compression piece 521 is inserted into the eccentric hole 515 of the rotating member 514 at a deviation angle. The compression member 528 is fixed to the holding body 524 and comprises an airbag 527, a check blocking piece 529, and a leakproof gasket 5210. A buckle 526 extending out from the airbag 527 runs through the holding body 524 and is buckled with a clamping groove 523 on the compression piece 521; and a first check valve 525 is arranged on the holding body 524 corresponding to the check blocking piece 529. In the example embodiment illustrated in FIGS. 17 to 21, the compression piece 521 is trilobal, each blade inclines upward at an appropriate angle, and the compression member 528 comprises three airbags 527 that are evenly arranged in the circumferential direction and respectively correspond to the three blades.

The air collecting part 53 and the compression member 528 define an air collecting chamber and a diversion groove 534, and the air collecting part 53 is provided with an air-supplementing pump air outlet 533. A flow channel 531 is arranged on the air collecting part 53 corresponding to the airbag 527. The flow channel 531 enables the air collecting chamber to be in fluid communication with the air-supplementing pump air outlet 533 and is provided with a second check valve 532 (such as a film gasket). The diversion groove 534 enables the airbag 527 to be in fluid communication with the first check valve 525.

After the motor is powered on, the rotating member 514 rotates rapidly, so that the linkage rod 522 inserted into the eccentric hole 515 runs therewith. The linkage rod 522 is eccentrically rotated to press the compression piece 521, and the compression piece 521 continuously presses the airbag 527 in a circumferential rotating motion manner, so as to output gas and send it to the air collecting part 53. When the gas is sent to the air collecting part 53 and the compression piece 521 presses the airbag 527, the first check valve 525 is tightly closed under the influence of an internal air pressure, and the second check valve 532 is pushed by the gas pushed out by the flow channel 531 to form a peripheral. When the airbag 527 is restored, the first check valve 525 is switched on and the gas is sucked into the airbag 527 from the air-supplementing pump air inlet 516 through the diversion groove 534, while the second check valve 532 is tightly closed under the influence of the internal air pressure. Because the compression piece 521 sequentially pushes the airbags 527 in a circumferential operation manner, actions of each airbag 527 and actions and paths of air flow operations are repeatedly performed in sequence with the aforementioned actions.

The gas inside the air collecting chamber is continuously pressed by the airbag 527, and the gas is uniformly ejected from a gas output hole 533 after being transmitted out through the flow channel 531. The second check valve 532 for preventing the gas from leaking back can effectively prevent the gas from flowing in a reverse direction from the flow channel 531. A leakproof gasket 5210 is arranged between the compression part 52 and the air collecting part 53, to keep an internal space at a certain air pressure value and to maintain an air output amount relatively stable.

It should be understood that the air-supplementing pump 5 is not limited to the type described above, and any other suitable air pump may be selected as the air-supplementing pump 5, as would be understood by one of skill in the art.

FIGS. 22 to 25 show an implementation of an air pressure sensor 7. The air pressure sensor 7 is a mechanical air pressure sensor in fluid communication with both the interior and the exterior of the inflatable body to accurately detect the internal air pressure value of the inflatable body.

The intelligent built-in air pump may comprise a partition member arranged in the accommodating chamber 11, and the partition member and the housing base 1 may define a closed chamber separated from the rest of the accommodating chamber 11 to accommodate the air pressure sensor 7 therein. As shown in FIG. 2 to FIG. 6, the partition member may be, for example, a partition plate 10 and a circuit board mounting base 82 of the control device 8. The circuit board mounting base 82 is fixed to the housing base 1 to hold a control circuit board 81. A first insertion slot 821 is formed on the circuit board mounting base 82, and a second insertion slot 19 is formed on the housing base 1. Two ends of the partition plate 10 are respectively inserted in the first insertion slot 821 and the second insertion slot 19, so that the circuit board mounting base 82, the partition plate 10, and the housing base 1 jointly define the closed chamber, and the air pressure sensor 7 is arranged in the closed chamber, so as to protect an air pressure measurement result from interference to the greatest extent.

The air pressure sensor 7 comprises a sensor housing and a movable membrane 73. The sensor housing is composed of a first housing 71 and a second housing 72. The movable membrane 73 may be at least partially located in the first housing 71 and the second housing 72. In some implementations of the air pressure sensor 7, when the first housing 71 and the second housing 72 are assembled together, a part of the movable membrane 73 (for example, the periphery of the movable membrane 73) is substantially located between the first housing 71 and the second housing 72 (see FIG. 24 and FIG. 25).

The air pressure sensor 7 may comprise at least one pin extending out from the second housing 72, e.g., a first pin 721 and a second pin 722 extending out from the second housing 72 in opposite directions. The air pressure sensor 7 cooperates with a first insertion hole 822 formed in the circuit board mounting base 82 through a first clamping part 724 on the first pin 721 and cooperates with a second insertion hole 17 formed in the housing base 1 through a second clamping part 725 on the second pin 722 (see FIG. 5). This makes it convenient to install the air pressure sensor 7. The air pressure sensor 7 may further comprise a vent pipe 723 extending out from the second housing 72; a pressure-measuring insertion hole 18 may be formed in the pressure-measuring port 14 of the housing base 1; and the vent pipe 723 may be fixed to the housing base 1 at the pressure-measuring insertion hole 18 and to enable the air pressure sensor 7 (specifically, a first pressure-measuring chamber 74 described below) to be in fluid communication with the interior of the inflatable body. In addition, an outer surface of the vent pipe 723 may be sleeved with a sealing ring 726, and the sealing ring 726 may be arranged between the housing base 1 and the second housing 72, so as to prevent internal gas of the inflatable body from leaking from the position.

The first pressure-measuring chamber 74 is located in an area substantially defined by the movable membrane 73 and the second housing 72. A second pressure-measuring chamber 75 is located in an area substantially defined by the movable membrane 73 and the first housing 71. The first pressure-measuring chamber 74 and the second pressure-measuring chamber 75 may be located on two substantially opposite sides of the movable membrane 73; the first pressure-measuring chamber 74 is in fluid communication with the interior of the inflatable body via the vent pipe 723 and the pressure-measuring port 14; and the second pressure-measuring chamber 75 is in fluid communication with the exterior of the inflatable body.

Figure 24:
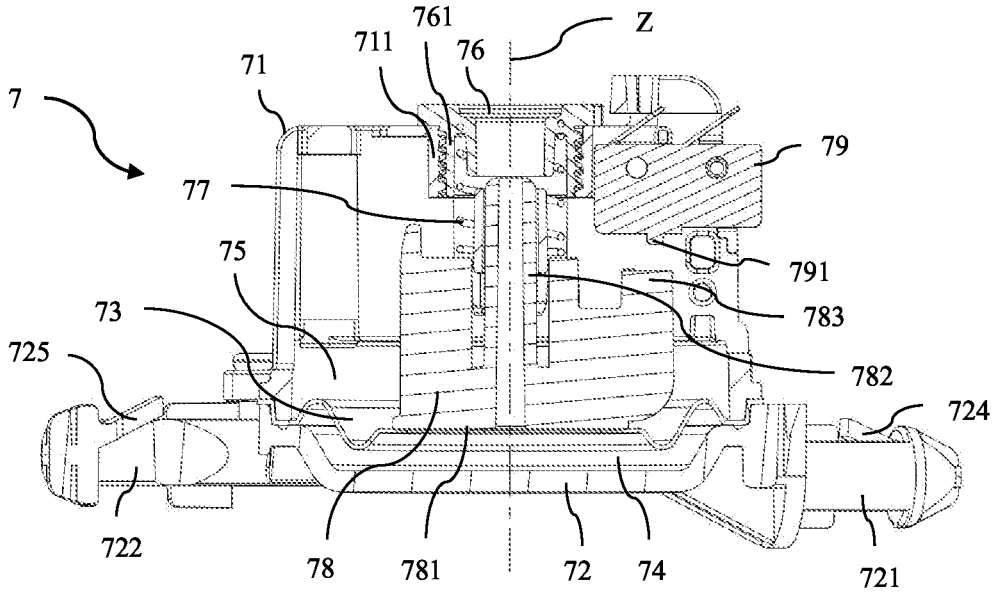
FIG. 24 is a schematic diagram of an operating state of the air pressure sensor of FIG. 1, showing a movable membrane in a relaxed position.
Figure 25:
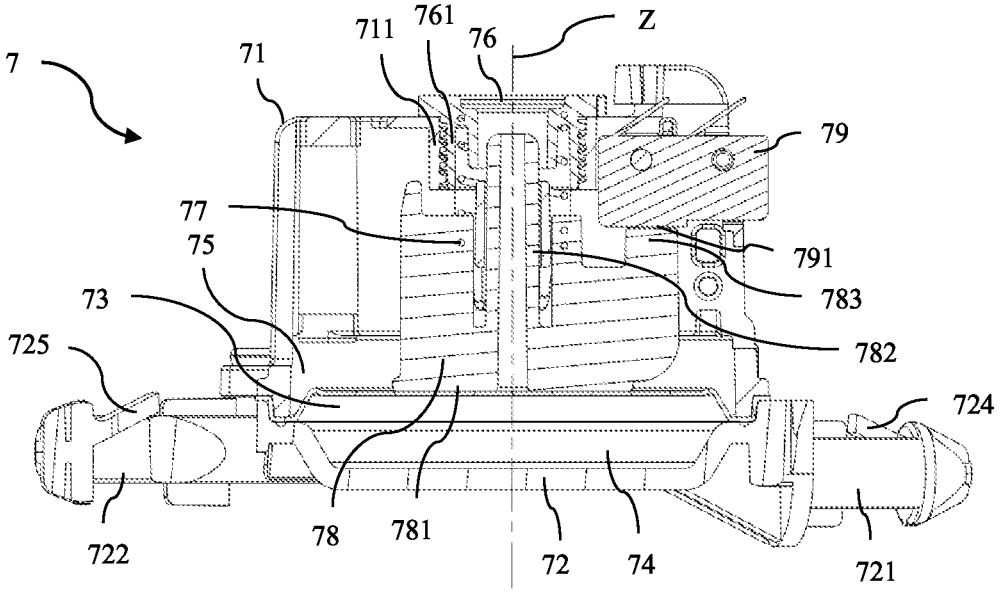
FIG. 25 is a schematic diagram of an operating state of the air pressure sensor of FIG. 1, showing the movable membrane in an unfolded position.

As shown in FIG. 24, the air pressure sensor 7 further comprises a knob 76, a housing thread 711, an adjusting rod spring 77, a pushing member 78, and an air pressure signal switch 79. The knob 76 is provided with a knob thread 761, and the housing thread 711 is formed on the first housing 71. The pushing member 78 comprises a contact surface 781, an adjusting rod 782, and a contact 783, wherein the contact surface 781 is used for connecting or contacting the movable membrane 73. When the air pressure inside the inflatable body rises, the air pressure inside the first pressure-measuring chamber 74 correspondingly rises and acts on the movable membrane 73 to push the movable membrane 73 toward the first housing 71. The movable membrane 73 pushes the pushing member 78 to move together, and when the air pressure inside the inflatable body drops, the air pressure inside the first pressure-measuring chamber 74 drops at the same time. Under the action of the adjusting rod spring 77, the pushing member 78 pushes the movable membrane 73 toward the second housing 72 to move together. FIG. 24 and FIG. 25 respectively show the movable membrane 73 in a relaxed position and an unfolded position.

The knob 76 can rotate relative to the first housing 71. When the knob 76 is rotated, the knob 76 can move longitudinally along a knob axis Z through the housing thread 711 and the knob thread 761 that match. The adjusting rod spring 77 may be sleeved around the adjusting rod 782, and because the knob 76 is moveable among different positions, the adjusting rod spring 77 can apply different degrees of force to the pushing member 78. The knob 76 is located at any of a number of different positions along the knob axis Z, so that the movable membrane 73 and the pushing member 78 may be subjected to different degrees of mechanical resistance.

The air pressure signal switch 79 electrically connected to the control device 8 is arranged on the first housing 71 and comprises a contact point 791. When the built-in air pump is in operation, the internal air pressure of the inflatable body makes the movable membrane 73 and the pushing member 78 move along the knob axis Z. If the pushing member 78 reaches a specific position along the knob axis Z, the contact 783 of the pushing member 78 is brought into contact with the contact point 791 of the air pressure signal switch 79 to activate the air pressure signal switch 79 to generate and send corresponding air pressure signals. Rotation of the knob 76 can change the internal air pressure of the inflatable body required for activating the air pressure signal switch 79. The contact 783 of the pushing member 78 may be aligned with the contact point 791 of the air pressure signal switch 79 in the moving direction of the pushing member 78, i.e., aligned in the longitudinal direction parallel to the knob axis Z, so that the pushing member 78 can accurately trigger the air pressure signal switch 79.

As shown in FIG. 2, the control device 8 comprises a control circuit board 81 and a circuit board mounting base 82. As mentioned above, the circuit board mounting base 82 holds the control circuit board 81 within the accommodating chamber 11 of the housing base 1. The main air pump 3, the airway switching device 4, the air-supplementing pump 5, and the air pressure sensor 7 are all electrically connected to the control circuit board 81.

When the control switch 91 on the panel 6 is rotated to control the main air pump 3 to inflate the inflatable body, the internal air pressure value of the inflatable body increases continuously, and the movable membrane 73 in the air pressure sensor 7 bulges toward the first housing 71 (i.e., the movable membrane 73 is in the unfolded position) until the contact 783 of the pushing member 78 abuts against the contact point 791 of the air pressure signal switch 79. This is an indication that the air pressure sensor 7 detects that the internal air pressure value of the inflatable body has reached a set threshold. Therefore, the air pressure sensor 7 sends a main air pump stop signal, and the control circuit board 81 automatically controls the main air pump 3 to stop running after receiving the main air pump stop signal. According to one or more example embodiments, after receiving the main air pump stop signal, the control circuit board 81 can turn on, e.g., an indicator light arranged on the panel 6 to prompt a user to turn off the control switch 91.

After the inflation of the inflatable body is completed, if the internal air pressure value of the inflatable body drops, the movable membrane 73 in the air pressure sensor 7 is reset toward the second housing 72 (i.e., the movable membrane 73 is in a relaxed position), and the contact 783 of the pushing member 78 is separated from the contact point 791 of the air pressure signal switch 79. This indicates that the air pressure sensor 7 detects that the internal air pressure value of the inflatable body is again lower than the set threshold. Therefore, the air pressure sensor 7 sends an air-supplementing pump operation signal, and the control circuit board 81 automatically controls the air-supplementing pump 5 to start operation after receiving the air-supplementing pump operation signal.

When the contact 783 of the pushing member 78 again abuts against the contact point 791 of the air pressure signal switch 79, this indicates that the air pressure sensor 7 detects that the internal air pressure value of the inflatable body has reached the set threshold again. Therefore, the air pressure sensor 7 sends an air-supplementing pump stop signal, and the control circuit board 81 automatically controls the air-supplementing pump 5 to stop running after receiving the air-supplementing pump stop signal. It can be understood that after the inflation of the inflatable body is completed, the air-supplementing pump 5 may be continuously switched between the operation state and the stop state as required, so that the internal air pressure of the inflatable body can be kept in a relatively constant range for a long time.

According to one or more example embodiments described herein, a built-in air pump may have a compact structure, a small volume, accurate air pressure control, no noise in an air-supplementing state, and a high air-supplementing efficiency.

It may be understood that the exemplary embodiments described herein may be considered in a descriptive sense only and not for purposes of limitation. Descriptions of features or aspects within each exemplary embodiment may be considered as available for other similar features or aspects in other exemplary embodiments.

While exemplary embodiments have been described with reference to the figures, it will be understood by those of ordinary skill in the art that various changes in form and details may be made therein without departing from the spirit and scope as defined by the following claims.

What is claimed is:

1. An air pump comprising:

an air pump housing comprising a first vent, a second vent, and a partition member disposed in an accommodating chamber defined within the air pump housing;

a first check valve disposed on the air pump housing and configured to open or close the first vent;

a main air pump disposed in the accommodating chamber, the main air pump configured to inflate and deflate an inflatable body via the first vent;

an airway switching device being disposed in the accommodating chamber and connected to the main air pump, wherein the airway switching device is configured to:

selectively switch among an inflating state, a deflating state, and a closed state, and selectively control the first check valve to open or close the first vent;

an air-supplementing pump disposed in the accommodating chamber and in fluid communication with the interior of the inflatable body to supplement air to the inflatable body;

a mechanical air pressure sensor disposed in a closed chamber within the accommodating chamber, the closed chamber defined by the partition member and the air pump housing, and configured to be in fluid communication with the inflatable body via a port in the air pump housing, the mechanical air pressure sensor comprising:

a sensor housing, a moveable membrane, a pushing member configured to move in a moving direction in conjunction with a movement of the moveable membrane, and at least one pin extending from the sensor housing in a direction substantially orthogonal to the moving direction and configured to cooperate with an insertion hole in at least one of the air pump housing and the partition member; and a control device disposed in the accommodating chamber and electrically connected to the main air pump, the airway switching device, the air-supplementing pump, and the air pressure sensor, the control device configured to:

send a main air pump stop signal based on the air pressure sensor detecting a threshold pressure in the inflatable body during operation of the main air pump; and send an air-supplementing pump operation signal based on the air pressure sensor detecting a pressure lower than the threshold pressure in the inflatable body when the main air pump is not in operation.

2. The air pump according to claim 1, wherein:

the movable membrane and the sensor housing define a first pressure-measuring chamber in fluid communication with the port in the air pump housing and a second pressure-measuring chamber in fluid communication with an exterior of the inflatable body;

the pushing member comprises a contact; and the mechanical air pressure sensor further comprises an air pressure signal switch electrically connected to the control device and comprising a contact point, and the contact point being in contact with the contact of the pushing member to thereby generate an air pressure signal.

3. The air pump according to claim 2, wherein the contact of the pushing member and the contact point of the air pressure signal switch are aligned with each other in the moving direction.

4. The air pump according to claim 2, wherein the air pressure sensor comprises a vent pipe extending from the sensor housing and fixed to the air pump housing at the port and thereby enabling fluid communication between the first pressure measuring chamber and the inflatable body.

5. The air pump according to claim 1, wherein the air-supplementing pump comprises:

a motor assembly comprising:

a motor body, a base fixed to the motor body and a rotating member comprising an eccentric hole, an air-supplementing pump air inlet a convex shaft extending from the motor body and through the base and nested with the rotating member;

a compression part comprising:

a compression piece, a holding body comprising a first check valve, a compression member fixed to the holding body and comprising an airbag, a check blocking piece corresponding to the first check valve, and a buckle extending from the airbag and buckled to the compression piece, a linkage rod extending from the compression piece and inserted into the eccentric hole; and an air collecting part comprising an air-supplementing pump air outlet;

wherein the air collecting part and the compression member together define an air collecting chamber and a diversion groove;

wherein a flow channel is disposed on the air collecting part corresponding to the airbag, the flow channel enabling fluid communication between the air collecting chamber and the air-supplementing pump air outlet, the flow channel comprising a second check valve; and wherein the diversion groove enables fluid communication between the airbag and the first check valve.

6. The air pump according to claim 1, further comprising sound-absorbing cotton at least partially covering the air-supplementing pump.

7. The air pump according to claim 1, wherein, in the inflating state, the airway switching device provides fluid communication between an output of the main air pump and the first vent, and in the deflating state, the airway switching device provides fluid communication between an input of the main air pump and the first vent.

8. An air pump comprising:

a housing comprising a first vent and a second vent;

a main air pump disposed in the housing and configured to pump fluid into and out of the first vent;

an air-supplementing pump disposed in the housing and configured to pump fluid into a supplementing port in the housing;

an air pressure sensor disposed in the housing and configured to sense a pressure via a pressure-measuring port in the housing, the air pressure sensor comprising a sensor housing, a moveable membrane, and a pushing member configured to move in a moving direction in conjunction with a movement of the moveable membrane, and at least one pin extending from the sensor housing in a direction substantially orthogonal to the moving direction and configured to cooperate with an insertion hole in the housing;

a controller disposed in the housing and electrically connected to the main air pump, the air-supplementing pump, and the air pressure sensor, wherein the controller is configured to:

control the a main air pump to stop pumping based on the air pressure sensor detecting a threshold pressure during operation of the main air pump; and control the air-supplementing pump to start pumping based on the air pressure sensor detecting a pressure lower than the threshold pressure when the main air pump is not in operation.

9. The air pump according to claim 8, further comprising a partition member disposed in the housing, wherein the air pressure sensor is disposed in a closed chamber defined by the partition member and the housing.

10. The air pump according to claim 9, wherein:

the moveable membrane divides an interior of the sensor housing into a first pressure chamber in communication with the pressure-measuring port and a second pressure chamber; and the air pressure sensor further comprises an air pressure signal switch electrically connected to the controller and configured to send an air pressure signal to the controller upon contact between a contact connected to the pushing member and a contact on the air pressure signal switch.

11. The air pump according to claim 10, wherein the air-supplementing pump comprises:

a motor assembly comprising: a motor body, a base fixed to the motor body and comprising an eccentric hole therethrough, a rotating member, an air inlet, and a shaft extending from the motor body, through the base and into the rotating member;

a compression part comprising: a compression piece, a holding body comprising a first check valve, a compression member fixed to the holding body and comprising an airbag in fluid communication with the first check valve, a linkage rod extending from the compression piece and into the eccentric hole, and an air collecting part comprising an air-supplementing pump air outlet in fluid communication with an air collecting chamber defined by the air collecting part and the compression member.

12. The air pump according to claim 8, further comprising sound-absorbing cotton at least partially covering the air-supplementing pump.

13. The air pump according to claim 8, further comprising:

an airway switching device disposed in the housing and connected to the main air pump, the airway switching device configured to selectively switch among an inflating state, a deflating state, and a closed state.

14. The air pump according to claim 13, wherein the airway switching device is further configured to selectively control a first check valve to open or close a first vent in the housing.

15. The air pump according to claim 14, wherein, in the inflating state, the airway switching device provides fluid communication between an output of the main air pump and the first vent, and in the deflating state, the airway switching device provides fluid communication between an input of the main air pump and the first vent.

16. The air pump according to claim 13, further comprising a first check valve disposed on the housing and configured to open or close the first vent;

wherein in the closed state, the switching device is configured to control the first check valve to close the first vent.

* * * * *